United States Patent [19]

Van Domelen

[11] Patent Number: 4,541,683

[45] Date of Patent: Sep. 17, 1985

[54] DEVICE FOR MOUNTING AN ELECTRICAL CONNECTOR TO A CONDUCTIVE PANEL

[75] Inventor: Joseph D. Van Domelen, Aloha, Oreg.

[73] Assignee: Tektronix, Inc., Beaverton, Oreg.

[21] Appl. No.: 553,617

[22] Filed: Nov. 21, 1983

[51] Int. Cl.[4] ..... H01R 13/518

[52] U.S. Cl. ..... 339/126 R; 339/14 R; 339/130 C

[58] Field of Search ..... 339/14 R, 177 E, 220 R, 339/17 C, 126, 123, 130 R, 130 C, 143 R

[56] References Cited

U.S. PATENT DOCUMENTS 3,154,366 10/1964 James et al. ..... 339/220 R
3,989,333 11/1976 Cauldwell ..... 339/17 C
4,043,629 8/1977 Brannen ..... 339/177 E X

*Primary Examiner*—Eugene F. Desmond
*Attorney, Agent, or Firm*—John Smith-Hill

[57] ABSTRACT

An electrical connector is mounted to a panel of conductive material by means of a board of dielectric material secured with one face engaging the panel and having a layer of electrically-conductive material on its other face. The layer of electrically conductive material is in conductive contact with the exterior of the connector. The exterior of the connector can thus be connected to the panel by inserting a conductive screw through the panel so that it contacts the metal layer.

6 Claims, 2 Drawing Figures

DEVICE FOR MOUNTING AN ELECTRICAL CONNECTOR TO A CONDUCTIVE PANEL

This invention relates to a device for mounting an electrical connector to a conductive panel.

BACKGROUND OF THE INVENTION

It is frequently desired to mount an electrical connector for coaxial cable to a conductive panel. Connectors for coaxial cable are generally cylindrical in form, having a conductive core and a metal shell. The shell itself is connected to the shield conductor of the cable, and is known as the shield connector. It is often desired to maintain electrical isolation between the shield connector and the conductive panel, but it may also be desired to ground the shield connector to the panel.

SUMMARY OF THE INVENTION

According to the first aspect of the present invention there is provided, in combination, and electrical connector having an electrically conductive exterior portion, and a device for mounting the electrical connector to a conductive panel formed with an aperture which is sufficiently large to enable the connector to be disposed therein without said exterior portion contacting the panel, said device comprising a board of dielectric material having first and second main faces and formed with an opening in which said connector can be fitted, the board being secured in use to the panel with the first main face of the board contacting the panel and so that a connector fitted in the opening of the board extends in the aperture of the panel without contacting the panel, and the device further comprising a layer of electrically conductive material on the second main face of the board and surrounding the opening therein, so as to enter into electrically-conductive contact with said exterior portion of the connector when the connector is fitted in said opening, and an electrically-conductive member for selectively connecting the layer of conductive material to the conductive panel.

According to a second aspect of the present invention, there is provided in combination, an electrical connector having an electrically conductive exterior portion, a panel of electrically conductive material formed with an aperture which is sufficiently large to enable the connector to be disposed therein without said exterior portion contacting the panel, and a device for mounting the electrical connector to the panel, said device comprising a board of dielectric material having first and second main faces and formed with an opening in which said connector can be fitted, the board being secured in use to the panel with the first main face of the board contacting the panel and so that a connector fitted in the opening of the board extends in the aperture of the panel without contacting the panel, and the device further comprising a layer of electrically-conductive material on the second main face of the board and surrounding the opening therein, so as to enter into electrically-conductive contact with said exterior portion of the connector when the connector is fitted in said opening, and an electrically-conductive member for selectively connecting the layer of electrically-conductive material to the panel.

BRIEF DESCRIPTION OF THE DRAWING

For a better understanding of the invention, and to show how the same may be carried into effect, reference will now be made, by way of example, to the accompanying drawings in which.

Figure 1:
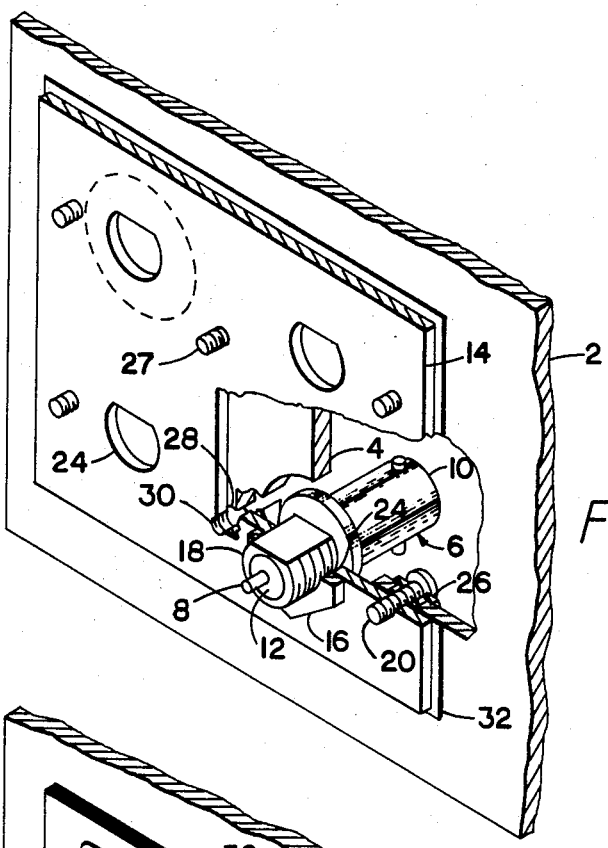
FIG. 1 is a fragmentary view illustrating use of a known device for mounting an electrical connector to a conductive panel.

The conductive panel 2 shown in FIG. 1 may be, for example, the front panel of a television monitor or of an accessory therefor. The panel is formed with several holes 4 for receiving connectors, such as BNC (Bayonet Neil-Concelman) connectors 6. A BNC connector (hereinafter referred to simply as "BNC") is a bayonet-coupled connector for coaxial cable and comprises two conductors, namely a core conductor 8 and a shell 10 maintained in predetermined relative positions by a body of dielectric material 12.

As illustrated in FIG. 1, it is conventional to mount the BNC 6 in the hole 4 using a metal plate 14 formed with a D hole 24 in which the BNC is secured by means of a nut 16 engaging threads 18 at the rear of the BNC. A foil 32 of dielectric material is positioned between the plate and the panel, and the screws 20 that are used to secure the plate 14 to the panel 2 are each provided with a dielectric bushing 26 so as to maintain electrical isolation between the panel and the plate. If it is desired to ground the shield connection 10 of the BNC, an additional screw 27 is fitted through a hole 28 in the panel and engages an internally-threaded hole 30 in the metal plate, and thus connects the plate 14 electrically to the panel 2.

Figure 2:
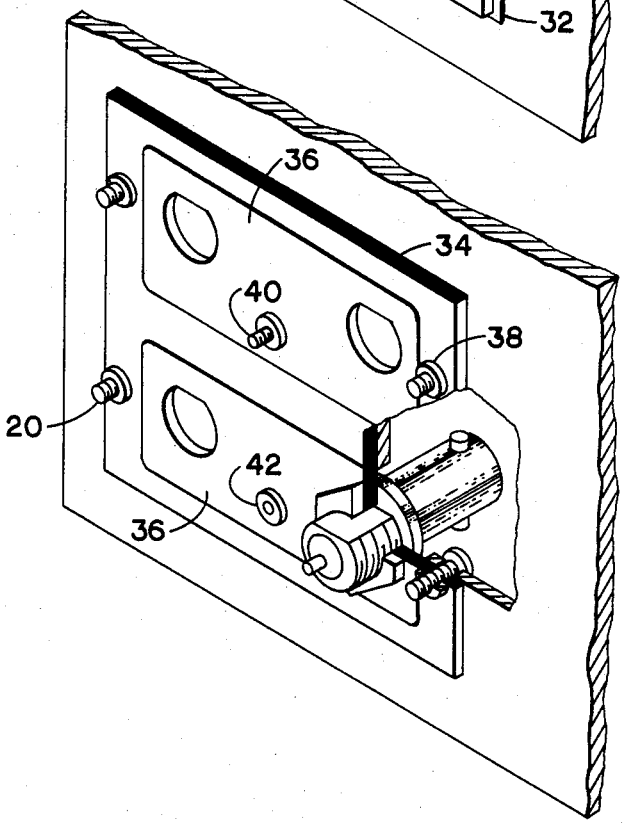
FIG. 2 is a fragmentary view of an electrical connector mounted to a conductive panel using the present invention.

In the arrangement shown in FIG. 2, the metal plate 14 and foil 32 are replaced by a board 34 of dielectric material having a layer 36 of metal on one side. The BNC is secured to the board 34 in the same manner as it is secured to the plate 14 in the case of FIGS. 1 and 2. The screws 20 securing the dielectric board 34 to the panel 2 engage internally-threaded metal sleeves 38 which are secured in holes in the dielectric board. The layer 36 is deposited on the face of the dielectric board that is further from the panel 2 and is in electrically-conductive contact with the shield connection of the BNC, and this layer can be connected to the panel 2, for grounding the shield connection, by means of a screw, such as shown at 40, engaging an internally-threaded metal sleeve 42 which is secured in a hole in the board 34 and is in electrically-conductive contact with the layer 36.

The sleeves 38 are disposed outside the area of the layer 36, and accordingly the screws 38 are not electrically connected to the shield connection. Consequently, it is not necessary to use insulating bushings to avoid electrical connection between the panel and the shield connection by way of the screws 38. As in the case of FIG. 1, insertion and removal of the screws 40 establishes and breaks electrical connection between the panel and the shield connection.

The board 34 is manufactured of the same type of material as an etched circuit board, e.g. epoxy glass, and the layer 36 is deposited on the board using conventional etched circuit board techniques. A board 1.5 mm thick has adequate structural strength.

It will be appreciated that when the term "conductive" is used herein, it means electrically conductive, as opposed to thermally conductive.

It will be appreciated that the invention is not restricted to the particular arrangement which has been shown and described with reference to FIG. 2, since variations may be made therein without departing from the scope of the invention as defined in the appended claims, and equivalents thereof. In particular, the invention is not restricted to use with BNCs, since it may be used with any type of coaxial connector.

I claim:

1. In combination, an electrical connector having an electrically conductive exterior portion, and a device for mounting the electrical connector to a panel of conductive material formed with an aperture which is sufficiently large to enable the connector to be disposed therein without said exterior portion contacting the panel, said device comprising a board of dielectric material having first and second main faces and formed with an opening in which which said connector can be fitted, the board being secured in use to the panel with the first main face of the board contacting the panel and so that a connector fitted in the opening of the board extends in the aperture of the panel without contacting the panel, and the device further comprising a layer of electrically conductive material on the second main face of the board and surrounding the opening therein, so as to enter into electrically-conductive contact with said exterior portion of the connector when the connector is fitted in said opening, and an electrically-conductive member for selectively connecting the layer of conductive material to the conductive panel, said layer of electrically conductive material covering a restricted area of the second main face of the board and leaving at least one portion of said second main face uncovered, so that electrically-conductive fastening means that are in electrically-conductive contact with the panel and pass through the board by way of said one portion may be used to secure the board to the panel without establishing an electrically-conductive connection between the panel and the layer.

2. A combination according to claim 1, wherein said electrically-conductive member compirses a metallic fastening member which can be inserted through a hole in the panel and engage the board.

3. A combination according to claim 2, wherein said fastening member is a screw, and the board is provided with an interanlly-threaded sleeve of conductive material in electrically conductive contact with the layer of conductive material, said screw engaging the board through said sleeve.

4. In combination, an electrical connector having an electrically-conductive exterior portion, a panel of electrically-conductive material formed with an aperture which is sufficiently large to enable the connector to be disposed therein without sAid exterior portion contacting the panel, and a device for mounting the electrical connector to the panel, said device comprising a board of dielectric. material having first and second main faces and formed with an opening in which said connector can be fitted, and a layer of electrically-conductive material on the second main face of the board and surrounding the opening therein, so as to enter into electrically-conductive contact with said exterior portion of the connector when the connector is fitted in said opening, said layer of electrically-conductive material covering a restricted area of the second main face of the board and leaving at least one portion of said second main face uncovered, the board being secured in use to the panel by electrically-conductive fastening means that are in electrically-conductive contact with the panel and pass through the board by way of said one portion without establishing an electrically-conductive connection between the panel and said layer, the board, when secured to the panel, having its first main face contacting the panel and being positioned so that a connector fitted in the opening of the board extends in the aperture of the panel without contacting the panel, and the device further comprising an electrically-conductive member for selectively connecting the layer of electrically-conductive material to the panel.

5. In combination, an electrical connector having an electrically-conductive exterior portion, a panel of electrically-conductive material formed with an aperture which is sufficiently large to enable the connector to be disposed therein without said exterior portion contacting the panel, and a device whereby the electrical connector is mounted to the panel, said device comprising a board of dielectric material having first and second main faces and formed with an opening in which said connector can be fitted, and a layer of electrically-conductive material on the second main face of the board and surrounding the opening therein, so as to enter into electrically-conductive contact with said exterior portion of the connector when the connector is fitted in said opening, said layer of electrically-conductive material covering a restricted area of the second main face of the board and leaving at least one portion of said second main face uncovered, and said device also comprising electrically-conductive fastening means that secure the board to the panel with the first main face of the board contacting the panel and so that a connector fitted in the opening of the board extends in the aperture of the panel without contacting the panel, said electrically-conductive fastening means being in electrically-conductive contact with the panel and passing through the board by way of said one portion without establishing an electrically-conductive connection between the panel and said layer, and the device further comprising an electrically-conductive member for selectively connecting the layer of electrically-conductive material to the panel.

6. A combination according to claim 5, wherein said fastening means comprise an internally-threaded member of conductive material secured to the board and an externally-threaded member of conductive material that extends through the panel and is in threaded engagement with said externally-threaded member.

* * * * *